United States Patent [19]

Smith

[11] Patent Number: 4,509,280

[45] Date of Patent: Apr. 9, 1985

[54] THREE-DIMENSIONAL GREETING CARD

[76] Inventor: Veronica Smith, 7 Smedley Dr., Newtown Square, Pa. 19073

[21] Appl. No.: 437,866

[22] Filed: May 19, 1983

[51] Int. Cl.[3] ..... G09F 7/00

[52] U.S. Cl. ..... 40/486; 40/417; 40/158 R; 446/72; 446/369

[58] Field of Search ..... 46/159; 40/1.6, 1.5, 40/486, 158, 411, 417, 418

[56] References Cited

U.S. PATENT DOCUMENTS

| | | | |
|---|---|---|---|
| 946,013 | 1/1910 | Clarke | 46/159 |
| 973,041 | 10/1910 | Hesselbarth | 40/1.6 |
| 1,389,551 | 8/1921 | Hennegan | 40/486 |
| 2,521,198 | 9/1950 | Adler | 40/1.6 |
| 3,293,783 | 12/1966 | Rosenfeld | 40/486 |
| 3,798,806 | 3/1974 | Sanford | 40/124.1 |
| 3,864,871 | 2/1975 | Kaelin | 46/158 |

*Primary Examiner*—Gene Mancene
*Assistant Examiner*—Wenceslao J. Contreras
*Attorney, Agent, or Firm*—John C. Dorfman

[57] ABSTRACT

A greeting and toy device comprises an animal simulating toy including a main body member consisting of a closed flexible soft envelope containing a soft resilient filler puffing the envelope and an animal part simulating section joined to the envelope and swingable between open and closed positions relative to a corresponding surface of the envelope, the confronting faces of the envelope and swingable section in the swingable section closed position and having adherent overlying message carrying panels which are exposed for reading in the swingable section open position.

1 Claim, 3 Drawing Figures

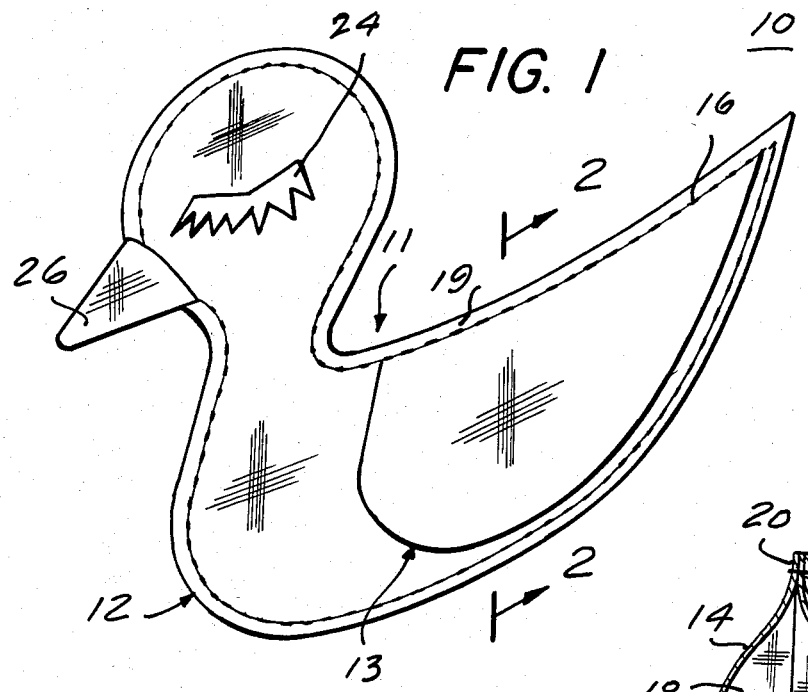
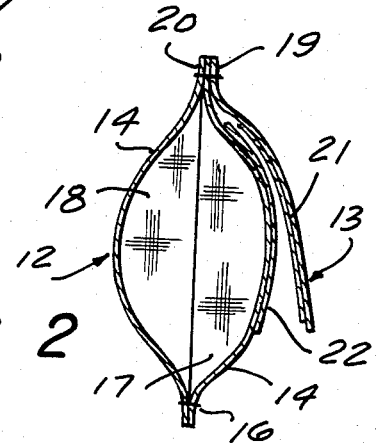
FIG 2
FIG. 3
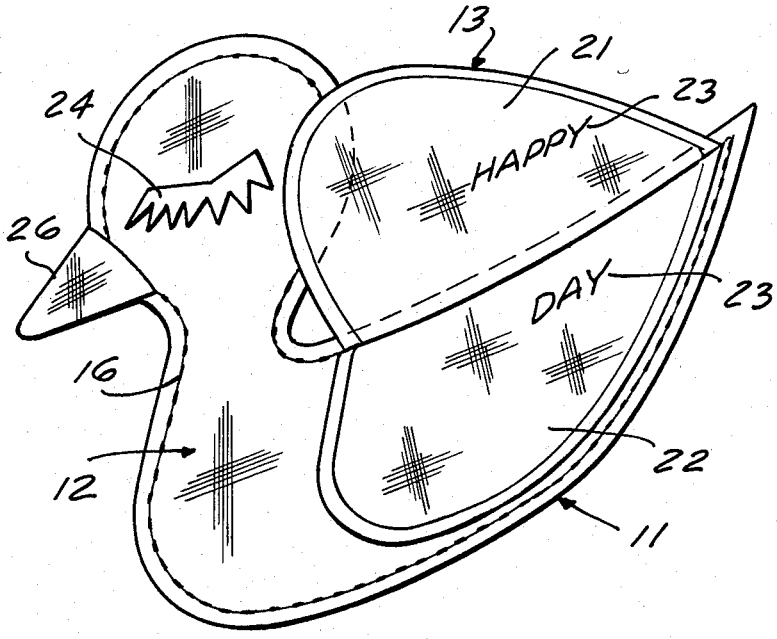

THREE-DIMENSIONAL GREETING CARD

BACKGROUND OF THE INVENTION

The present invention relates generally to improvements in information carrying devices and it relates more particularly to an improved greeting card toy device.

The conventional printed announcement or message such as a greeting card or the like is generally formed of a stiff paper or similar material which has imprinted thereon illustrative material, legends, announcements and other information and messages and contains one or more hinged sheets to facilitate the closing thereof for mailing purposes. Many other types of greeting cards have been proposed such as those having collapsed structures which are automatically erected with the opening of the card and the like. However, the greeting card heretofore available and proposed possess many drawbacks and disadvantages. Where they are more than a mere card or folder they are expensive and often awkward devices of limited application and those of the conventional construction are of limited appeal and attraction and are generally discarded or forgotten after they have been received.

SUMMARY OF THE INVENTION

It is a principal object of the present invention to provide an improved message or information bearing device.

Another object of the present invention is to provide an improved message or information bearing toy.

Still another object of the present invention is to provide an improved greeting card toy.

A further object of the present invention is to provide an improved greeting card in the form of a stuffed toy.

Still a further object of the present invention is to provide an improved article of the above nature characterized by its attractive appearance, low cost, ruggedness, and great versitility and adaptability.

The above and other objects of the present invention will become apparent from a reading of the following description taken in conjunction with the accompanying drawing which illustrates a preferred embodiment thereof.

An informative carrying toy device is accordance with the present invention comprises a body member including an envelope section formed of a flexible web and containing a soft compressible filler and a second section joined to the envelope section and swingable relative to the envelope section between a proximate closed position and an open position, the envelope and second sections having respectively first and second faces which in overlying confronting relationship in the closed position of the second section and are visually accessably exposed in the open position of the second section and visual information carried in at least one of the first and second faces.

In accordance with a preferred embodiment of the present invention the body member simulates a somewhat flattened animal, for example, a bird, with the second section stimulating a wing thereof. The envelope and second sections are formed of a textile fabric and the first and second faces are overlaid with correspondingly shaped paper sheets which have a greeting or other message imprinted thereon.

The improved message carrying toy is an attractive greeting device of great versitility and adaptability and which tends to be retained and fondly remembered.

BRIEF DESCRIPTION OF THE DRAWING

FIG. 1 is a front elevational view of a greeting device embodying the present invention shown in its closed condition;

FIG. 2 is a sectional view taken along line 2—2 in FIG. 1; and

FIG. 3 is a view similar to FIG. 1 but shown in an open condition providing visual access to the message.

DESCRIPTION OF THE PREFERRED EMBODIMENT

Referring now to the drawing which illustrates a preferred embodiment of the present invention the reference numeral 10 generally designates the improved greeting card device which simulates a duckling, it being understood that the device 10 may simulate any other animal, flower article or structure as discreet. The device 10 comprises a body member 11 which includes a main section 12 formed in the shape of the body of the bird and an auxilliary section or flap 13 having the outline of a wing of the bird.

The body member main section 12 is formed of a pair of panels 14 of soft flexible webbing preferrably a cotton or rayon felt or other non-woven, woven, or knitted material of natural artificial or synthetic fibers. Panels 14 include bird body and head portions and have coinciding peripheral borders which are mutually securred by a line of stitching 16 or in any other suitable manner to form a closed envelope 17. Contained within and expanding or puffing the envelope 17 to define the body main section is a soft, compressible resilient filler or pad 18 which is advantageously formed of material or synthetic fibers such as cotten, polyester fibers, nylon fabric or the like.

The auxilliary wing simulating section 13 is advantageously formed of a flexible material similar to that forming panels 14 and has an upper border 19 coinciding with and overlying the corresponding upper preferrably linear border 20 of proximate panel 14. The coinciding borders 19 and 20 are mutually secured by stitching 16 or in any other suitable manner. Thus flap 13 is swingable between a closed position as shown in FIGS. 1 and 2 with the outside face of adjacent panel 14 and the inside face of flap 13 being in confronting close or overlying proximity and an open position as shown in FIG. 3 with such faces being fully exposed and visually accessible.

A flexible paper panel 21 similar in shape to and sightly smaller than flap 13 is cemented or otherwise secured to the inside face of flap 13 and a flexible paper panel 22 is likewise secured to the outside face of panel 14 so as to substantially coincide or register with paper panel 21 in the closed position of flap 13. The exposed faces of paper panels 21 and 22 have printed thereon or otherwise applied thereto a legend or greeting 23 or any other information or illustration. Additionally, the border member main section may be decorated as desired, for example, by the suitable application thereto of an eyebrow simulating applique 24 and a beak extension 26 to the head portion of the body member main section 11.

When employed as a greeting card, the message 23 is any desired greeting and any additional hand written material and the device 10, with wing flap 13 closed, is sufficiently thin to be inserted in a suitably sized conventional envelope and mailed in the usual manner. The recipient merely removes device 10 from the envelope and swings wing flap 13 to its open position to expose panels 21 and 22 so that the greeting 23 may be seen and read. Thereafter the device 10 may be employed in the usual manner as a stuffed toy with the message 23 inact.

While there has been described and illustrated a preferred embodiment of the present invention numerous alterations omissions and additions may be made without departing from the spirit thereof. For example, wing flaps 13 may be applied to opposite sides of the animal body member and each together with the opposing body member face may carry a different message. Moreover, other animal figures and simulated structures may be employed and both the flap and the main body member may be stuffed or the body member as such may be formed and defined by a pair of hinges complementary sections carrying a message on the confronting faces of such sections. Furthermore, the flap 13 may simulate other animal parts, sections or appendages.

I claim:

1. An information carrying toy device comprising a body member shaped to simulate at least a portion of an animated creature including a double layered first section in the form of an envelope having two panels of a soft flexible fabric web, the two panels being secured together around their periphery, which is shaped to define the animated creature, and containing a soft compressible filler of such form and size to resiliently space the panels apart a maximum distance small compared to the longitudinal dimension of the first section in order to provide a dimension of thickness to the first section, a second flap section of soft flexible fabric web joined to said first section at least along a seam providing a hinge, said first and second sections having surfaces which are in overlying confronting relationships in a closed position, representation of features simulating animation, including at least one eye, being applied to visible parts of the sections when the flap is closed on the side of the first section to which the second is attached, such that the toy has an enhanced appearance of an animated creature, at least in the closed flap position, and an information display carried on at least one of the confronting faces, whereby using the seam as a hinge the second section may be moved relative to the first section about the hinge to an open position so as to expose the information display to view.

* * * * *